US008026722B2

(12) United States Patent
McElhinney

(10) Patent No.: US 8,026,722 B2
(45) **Date of Patent: *Sep. 27, 2011**

(54) METHOD OF MAGNETIZING CASING STRING TUBULARS FOR ENHANCED PASSIVE RANGING

(75) Inventor: Graham A. McElhinney, Inverurie (GB)

(73) Assignee: Smith International, Inc., Houston, TX (US)

( * ) Notice: Subject to any disclaimer, the term of this patent is extended or adjusted under 35 U.S.C. 154(b) by 131 days.

This patent is subject to a terminal disclaimer.

(21) Appl. No.: 12/426,694

(22) Filed: Apr. 20, 2009

(65) Prior Publication Data

US 2009/0201026 A1 Aug. 13, 2009

Related U.S. Application Data

(63) Continuation-in-part of application No. 11/301,762, filed on Dec. 13, 2005, now Pat. No. 7,656,161.

(30) Foreign Application Priority Data

Dec. 20, 2004 (CA) ..... 2490953

(51) Int. Cl.
*G01V 3/08* (2006.01)

(52) U.S. Cl. ..... 324/346; 324/355

(58) Field of Classification Search ..... 324/345–346, 324/350–352, 354–356, 366, 368–372; 702/6–13; 166/250.01, 252.2, 253.1, 254.1, 254.2, 255.1
See application file for complete search history.

(56) References Cited

U.S. PATENT DOCUMENTS

| | | | |
|---|---|---|---|
| 2,980,850 | A | 4/1961 | Cochran |
| 3,117,065 | A | 1/1964 | Wootten |
| 3,725,777 | A | 4/1973 | Robinson et al. |
| 4,072,200 | A | 2/1978 | Morris et al. |
| 4,458,767 | A | 7/1984 | Hoehn, Jr. |
| 4,465,140 | A | 8/1984 | Hoehn, Jr. |
| 4,672,345 | A | 6/1987 | Littwin |
| 4,730,230 | A | 3/1988 | Helfrick |
| 4,743,849 | A | 5/1988 | Novikov |
| 4,931,760 | A | 6/1990 | Yamaguchi |
| 5,025,240 | A | 6/1991 | La Croix |

(Continued)

FOREIGN PATENT DOCUMENTS

CA 2490953 6/2006

(Continued)

OTHER PUBLICATIONS

A.G. Nekut, et al., "Rotating magnet Ranging—A new drilling guidance technology," 8th One Day Conference on Horizontal Well Technology, Canadian Sections SPE/Petroleum Society, Nov. 7, 2001.

(Continued)

*Primary Examiner* — Bot Ledynh

(57) ABSTRACT

A method for magnetizing a wellbore tubular includes magnetizing the tubular at three or more discrete locations on the tubular. In exemplary embodiments the magnetized wellbore tubular includes at least one pair of opposing magnetic poles located between longitudinally opposed ends of the tubular. Wellbore tubulars magnetized in accordance with this invention may be coupled to one another to provide a magnetic profile about a section of a casing string. Passive ranging measurements of the magnetic field about the casing string may be utilized to survey and guide drilling of a twin well. Such an approach advantageously obviates the need for simultaneous access to both wells.

18 Claims, 7 Drawing Sheets

U.S. PATENT DOCUMENTS

| | | | | |
|---|---|---|---|---|
| 5,126,720 | A | 6/1992 | Zhou et al. | |
| 5,148,869 | A | 9/1992 | Sanchez | |
| 5,230,387 | A | 7/1993 | Waters et al. | |
| 5,319,335 | A | 6/1994 | Huang et al. | |
| 5,428,332 | A | 6/1995 | Srail et al. | |
| 5,485,089 | A | 1/1996 | Kuckes | |
| 5,512,830 | A | 4/1996 | Kuckes | |
| 5,541,517 | A | 7/1996 | Hartmann et al. | |
| 5,589,775 | A | 12/1996 | Kuckes | |
| 5,657,826 | A | 8/1997 | Kuckes | |
| 5,659,280 | A | 8/1997 | Lee et al. | |
| 5,675,488 | A | 10/1997 | McElhinney | |
| 5,762,149 | A | 6/1998 | Donovan et al. | |
| 5,923,170 | A | 7/1999 | Kuckes | |
| 6,055,213 | A | 4/2000 | Rubbo et al. | |
| 6,060,970 | A | 5/2000 | Bell | |
| 6,273,076 | B1 | 8/2001 | Beck et al. | |
| 6,310,532 | B1 | 10/2001 | Santa Cruz et al. | |
| 6,369,679 | B1 | 4/2002 | Cloutier et al. | |
| 6,670,806 | B2 | 12/2003 | Wendt et al. | |
| 6,698,516 | B2 | 3/2004 | Van Steenwyk et al. | |
| 6,937,023 | B2 | 8/2005 | McElhinney | |
| 6,985,814 | B2 | 1/2006 | McElhinney | |
| 6,987,228 | B1 | 1/2006 | MacMichael et al. | |
| 6,991,045 | B2 | 1/2006 | Vinegar et al. | |
| 7,816,922 | B2 * | 10/2010 | McElhinney | 324/346 |
| 7,816,923 | B2 * | 10/2010 | McElhinney | 324/346 |
| 2004/0051610 | A1 | 3/2004 | Sajan | |
| 2004/0119607 | A1 | 6/2004 | Davies et al. | |
| 2004/0128081 | A1 | 7/2004 | Rabitz et al. | |
| 2004/0263300 | A1 | 12/2004 | Maurer et al. | |
| 2006/0131013 | A1 | 6/2006 | McElhinney | |

FOREIGN PATENT DOCUMENTS

| | | | |
|---|---|---|---|
| EP | 0301671 | B1 | 2/1989 |
| GB | 2376747 | A | 8/2002 |
| JP | 60086809 | A | 5/1985 |
| JP | 03094407 | A | 4/1991 |
| WO | 95/19490 | | 7/1995 |

OTHER PUBLICATIONS

J.I. De Lange and T.J. Darling, "Improved detectability of blowing wells," SPE Drilling Engineering, Mar. 1990.

W-D Coils brochure by Western Instruments, published Mar. 2001: http://www.westerninstruments.com/portableMPI/coils/WD_COI_1.jpg, http://www.westerninstruments.com/portableMPI/coils/WD_COI_2.gif; and http://www.westerninstruments.com/portableMPI/coils/WD_COI_3.gif.

7. T.L. Grills, "Magnetic ranging technologies for drilling steam assisted gravity drainage well pairs and unique well geometries—A comparison of Technologies," SPE/Petroleum Society of CIM/CHOA 79005, 2002.

* cited by examiner

METHOD OF MAGNETIZING CASING STRING TUBULARS FOR ENHANCED PASSIVE RANGING

RELATED APPLICATIONS

This application is a continuation-in-part of co-pending, commonly-invented and commonly-assigned U.S. patent application Ser. No. 11/301,762 entitled MAGNETIZATION OF TARGET WELL CASING STRING TUBULARS FOR ENHANCED PASSIVE RANGING, filed Dec. 13, 2005, which claims priority to commonly-invented, commonly-assigned, co-pending Canadian patent application serial no. 2,490,953, filed Dec. 20, 2004.

FIELD OF THE INVENTION

The present invention relates generally to drilling and surveying subterranean boreholes such as for use in oil and natural gas exploration. In particular, this invention relates to a method of magnetizing a string of wellbore tubulars to enhance the magnetic field about a target borehole. Moreover this invention also relates to a method of passive ranging to determine bearing and/or range to such a target borehole during drilling of a twin well.

BACKGROUND OF THE INVENTION

The use of magnetic field measurement devices (e.g., magnetometers) in prior art subterranean surveying techniques for determining the direction of the earth's magnetic field at a particular point is well known. The use of accelerometers or gyroscopes in combination with one or more magnetometers to determine direction is also known. Deployments of such sensor sets are well known, for example, to determine borehole characteristics such as inclination, borehole azimuth, positions in space, tool face rotation, magnetic tool face, and magnetic azimuth (i.e., the local direction in which the borehole is pointing relative to magnetic north). Moreover, techniques are also known for using magnetic field measurements to locate magnetic subterranean structures, such as a nearby cased borehole (also referred to herein as a target well). For example, such techniques are sometimes used to help determine the location of a target well, for example, to reduce the risk of collision and/or to place the well into a kill zone (e.g., near a well blow out where formation fluid is escaping to an adjacent well).

The magnetic techniques used to sense a target well may generally be divided into two main groups; (i) active ranging and (ii) passive ranging. In active ranging, the local subterranean environment is provided with an external magnetic field, for example, via a strong electromagnetic source in the target well. The properties of the external field are assumed to vary in a known manner with distance and direction from the source and thus in some applications may be used to determine the location of the target well. The use of certain active ranging techniques, and limitations thereof, in twin well drilling is discussed in more detail below.

In contrast to active ranging, passive ranging techniques utilize a preexisting magnetic field emanating from magnetized components within the target borehole. In particular, conventional passive ranging techniques generally take advantage of remanent magnetization in the target well casing string. Such remanent magnetization is typically residual in the casing string because of magnetic particle inspection techniques that are commonly utilized to inspect the threaded ends of individual casing tubulars.

Various passive ranging techniques have been developed in the prior art to make use of the aforementioned remanent magnetization of the target well casing string. For example, as early as 1971, Robinson et al., in U.S. Pat. No. 3,725,777, disclosed a method for locating a cased borehole having remanent magnetization. Likewise, Morris et al., in U.S. Pat. No. 4,072,200, and Kuckes, in U.S. Pat. No. 5,512,830, also disclose methods for locating cased boreholes having remanent magnetization. These prior art methods are similar in that each includes making numerous magnetic field measurements along the longitudinal axis of an uncased (measured) borehole. For example, Kuckes assumes that the magnetic field about the target well varies sinusoidally along the longitudinal axis thereof. Fourier analysis techniques are then utilized to determine axial and radial Fourier amplitudes and the phase relationships thereof, which may be processed to compute bearing and range (direction and distance) to the target borehole. Moreover, each of the above prior art passive ranging methods makes use of the magnetic field strength and/or a gradient of the magnetic field strength to compute a distance to the target well. For example, Morris et al. utilize measured magnetic field strengths at three or more locations to compute gradients of the magnetic field strength along the measured borehole. The magnetic field strengths and gradients thereof are then processed in combination with a theoretical model of the magnetic field about the target well to compute a distance between the measured and target wells.

While the above mentioned passive ranging techniques attempt to utilize the remanent magnetization in the target well, and thus advantageously do not require positioning an active magnetic or electromagnetic source in the target borehole, there are drawbacks in their use. For example, the magnetic field strength and pattern resulting from the remanent magnetization of the casing string tubulars is inherently unpredictable for a number of reasons. First, the remanent magnetization of the target borehole casing results from magnetic particle inspection of the threaded ends of the casing tubulars. This produces a highly localized magnetic field at the ends of the casing tubulars, and consequently at the casing joints within the target borehole. Between casing joints, the remanent magnetic field may be so weak that it cannot be detected reliably. A second cause of the unpredictable nature of the remanent magnetism is related to handling and storage of the magnetized tubulars. For example, the strength of the magnetic fields around the ends of the tubulars may change as a result of interaction with other magnetized ends during storage of the tubulars prior to deployment in the target borehole (e.g., in a pile at a job site). Finally, the magnetization used for magnetic particle inspection is not carefully controlled because the specific strength of the magnetic field imposed is not important. As long as the process produces a strong enough field to facilitate the inspection process, the field strength is sufficient. The resulting field can, therefore, vary from one set of tubulars to another. These variations cannot be quantified or predicted because no record is generally maintained of the magnetization process used in magnetic particle inspection.

Consistent with the above, the Applicant has observed that the magnetic pole strength may vary from one wellbore tubular to the next by a factor of 10 or more. Moreover, the magnetic poles may be distributed randomly within the casing string, resulting in a highly unpredictable magnetic field about the target well. As such, determining distance from magnetic field strength measurements and/or gradients of the magnetic field strength is problematic. A related drawback of prior art passive ranging methods that rely on the gradient of the residual magnetic field strength is that measurement of the gradient tends to be inherently error prone, in particular in regions in which the residual magnetic field strength of the casing is small relative to the local strength of the earth's magnetic field. Reliance on such a gradient may cause errors in calculated distance between the measured and target wells.

McElhinney, in co-pending, commonly assigned U.S. patent application Ser. No. 10/705,562 (now U.S. Pat. No. 6,985,814), discloses a passive ranging methodology, for use in well twinning applications, in which two-dimensional magnetic interference vectors are typically sufficient to determine both the bearing and range to the target well. The two-dimensional interference vectors are utilized to determine a tool face to target angle (i.e., the direction) to the target well, e.g., relative to the high side of the measured well. The tool face to target angles at first and second longitudinal positions in the measured well may also be utilized to determine distance to the target well. The McElhinney disclosure addresses certain drawbacks with the prior art in that neither the strength of the remanent magnetic field nor gradients thereof are required to determine distance. Moreover, the bearing and range to the target well may be determined at a single survey station for a downhole tool having first and second longitudinally spaced magnetic field sensors.

While the above described McElhinney technique and other passive ranging techniques have been successfully utilized in commercial well twinning applications, their effectiveness is limited in certain applications. For example, passive ranging techniques are limited by the relatively weak remanent magnetic field about the target well and by the variability of such fields. At greater distances (e.g., greater than about 4 to 6 meters) a weak or inconsistent magnetic field about the target well reduces the accuracy and reliability of passive ranging techniques. Even at relatively smaller distances there are sometimes local regions about the target well where the remanent magnetic field is too weak to make accurate range and bearing measurements. Active ranging techniques, on the other hand, produce a more consistent and predictable field around the target borehole. For this reason active ranging techniques have been historically utilized for many well twinning applications.

For example, active ranging techniques are commonly utilized in the drilling of twin wells for steam assisted gravity drainage (SAGD) applications. In such SAGD applications, twin horizontal wells having a vertical separation distance typically in the range from about 4 to about 20 meters are drilled. Steam is injected into the upper well to heat the tar sand. The heated heavy oil contained in the tar sand and condensed steam are then recovered from the lower well. The success of such heavy oil recovery techniques is often dependent upon producing precisely positioned twin wells having a predetermined relative spacing in the horizontal injection/production zone (which often extends up to and beyond 1500 meters in length). Positioning the wells either too close or too far apart may severely limit production, or even result in no production, from the lower well.

Prior art methods utilized in drilling such wells are shown on FIGS. 1A and 1B. In each prior art method, the lower production well 30 is drilled first, e.g., near the bottom of the oil-bearing formation, using conventional directional drilling and measurement while drilling (MWD) techniques. In the method shown on FIG. 1A, a high strength electromagnet 34 is pulled down through the cased target well 30 via tractor 32 during drilling of the upper well 20. An MWD tool 26 deployed in the drill string 24 near drill bit 22 measures the magnitude and direction of the magnetic field during drilling of the upper well 20. In the method shown on FIG. 1B, a magnet 27 is mounted on a rotating collar portion of drilling motor 28 deployed in upper well 20. A wireline MWD tool 36 is pulled (via tractor 32) down through the cased target well 30 and measures the magnitude and direction of the magnetic field during drilling of the upper well 20. Both methods utilize the magnetic field measurements (made in the upper well 20 in the approach shown on FIG. 1A and made in the lower well 30 in the approach shown on FIG. 1B) to compute a range and bearing from the upper well 20 to the lower well 30 and to guide continued drilling of the upper well 20.

The prior art active ranging methods described above, while utilized commercially, are known to include several significant drawbacks. First, such methods require simultaneous and continuous access to both the upper 20 and lower 30 wells. As such, the wells must be started a significant distance from one another at the surface. Moreover, continuous, simultaneous access to both wells tends to be labor and equipment intensive (and therefore expensive) and can also present safety concerns. Second, the remanent magnetization of the casing string (which is inherently unpredictable as described above) is known to sometimes interfere with the magnetic field generated by the electromagnetic source (electromagnet 34 on FIG. 1A and magnet 27 on FIG. 1B). While this problem may be overcome, (e.g., in the method shown on FIG. 1A magnetic field measurements are made at both positive and negative electromagnetic source polarities), it is typically at the expense of increased surveying time, and thus an increase in the time and expense required to drill the upper well. Third, the above described prior art active ranging methods require precise lateral alignment between the magnetic source deployed in one well and the magnetic sensors deployed in the other. Misalignment can result in a misplaced upper well, which as described above may have a significant negative effect on productivity of the lower well. Moreover, the steps taken to assure proper alignment (such as making magnetic field measurements at multiple longitudinal positions in one of the wells) are time consuming (and therefore expensive) and may further be problematic in deep wells. Fourth, a downhole tractor 32 is often required to pull the magnetic source 34 (or sensor 36 on FIG. 1B) down through the lower well 30. In order to accommodate such tractors 32, the lower well 30 must have a sufficiently large diameter (e.g., on the order of 12 inches or more). Thus, elimination of the tractor 32 may advantageously enable the use of more cost effective, smaller diameter (e.g., seven inch) production wells. Moreover, in a few instances, such downhole tractors 32 have been known to become irretrievably lodged in the lower well 30.

Therefore, there exists a need for improved magnetic ranging methods suitable for twin well drilling (such as twin well drilling for the above described SAGD applications). In particular, there exists a need for a magnetic ranging technique that combines advantages of active ranging and passive ranging techniques without inheriting disadvantages thereof.

SUMMARY OF THE INVENTION

Exemplary aspects of the present invention are intended to address the above described drawbacks of prior art ranging and twin well drilling methods. One aspect of this invention includes a method for magnetizing a wellbore tubular such that the wellbore tubular includes at least three discrete magnetized zones. In one exemplary embodiment, the wellbore tubular also includes at least one pair of opposing magnetic poles (opposing north-north and/or opposing south-south poles) located between longitudinally opposed ends of the tubular. A plurality of such magnetized wellbore tubulars may be coupled together and lowered into the target well to form a magnetized section of a casing string. In such an exemplary embodiment, the magnetized section of the casing string includes a plurality of longitudinally spaced pairs of opposing magnetic poles having an average longitudinal spacing less than the length of a wellbore tubular. The magnetic field about such a casing string may be mapped using a mathematical model. Passive ranging measurements of the magnetic field may be advantageously utilized to survey and guide continued drilling of a twin well relative to the target well.

Exemplary embodiments of the present invention advantageously combine advantages of active and passive ranging techniques without inheriting disadvantages inherent in such prior art techniques. For example, when the present invention is used, target well casing strings having a strong, highly uniform remanent magnetic field thereabout may be configured. Measurements of the remanent magnetic field strength are thus typically suitable to determine distance to the target well and may be advantageously utilized to drill a twin well along a predetermined course relative to the target well. Such an approach advantageously obviates the need for simultaneous access to the target and twin wells (as is presently required in the above described active ranging techniques). As such, in SAGD applications, this invention eliminates the use of a downhole tractor in the target well and thus may enable smaller diameter, more cost effective production wells to be drilled. Moreover, this invention simplifies twinning operations because it does not typically require lateral alignment of a measurement sensor in the twin well with any particular point(s) on the target well.

In one aspect the present invention includes a method for creating a magnetic profile around a length of coupled wellbore tubulars. The method includes magnetizing a first wellbore tubular at three or more locations along a length of the tubular, such that the magnetized tubular includes a single pair of opposing NN poles in a central region of the tubular and magnetizing a second wellbore tubular at three or more locations along a length of the tubular, such that the magnetized tubular includes a single pair of opposing SS poles in a central region of the tubular. The first and second wellbore tubulars may then be coupled to one another.

In another aspect, this invention includes a method for creating a magnetic profile around a length of coupled wellbore tubulars. The method includes positioning a first wellbore tubular substantially coaxially in at least four longitudinally spaced magnetizing coils deployed on a frame and connecting the coils to an electrical power source. The electrical connection causes a direct electrical current to flow in a clockwise direction about the tubular in a first subset of the coils and in a counterclockwise direction about the tubular in a second subset of the coils so as to impart a pair of NN opposing poles in a central region of the first wellbore tubular. The coils are then disconnected from the power source and the tubular removed from the coils. A second wellbore tubular is positioned substantially coaxially in the coils and the coils connected to the electrical power source. The electrical connection causes a direct electrical current to flow in a clockwise direction about the tubular in the second subset of the coils and in a counterclockwise direction about the tubular in the first subset of the coils so as to impart a pair of SS opposing poles in a central region of the tubular. The coils are then disconnected form the power source the tubular removed from the coils. The first and second wellbore tubulars are coupled to one another.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realize by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1A:
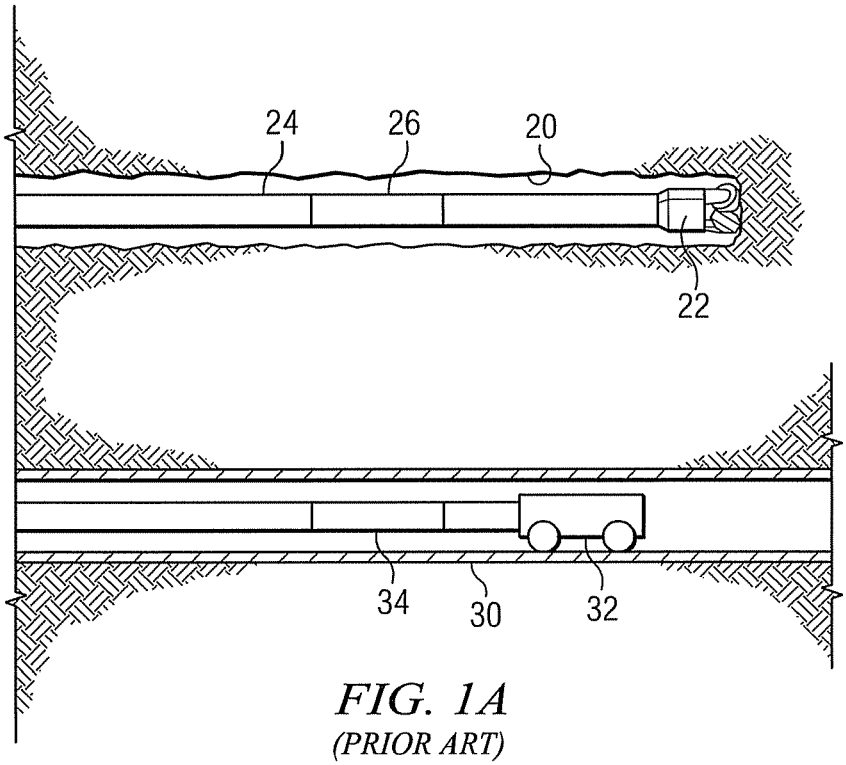
FIG. 1A (PRIOR ART)
FIGS. 1A and 1B depict prior art methods for drilling twin wells.
Figure 1B:
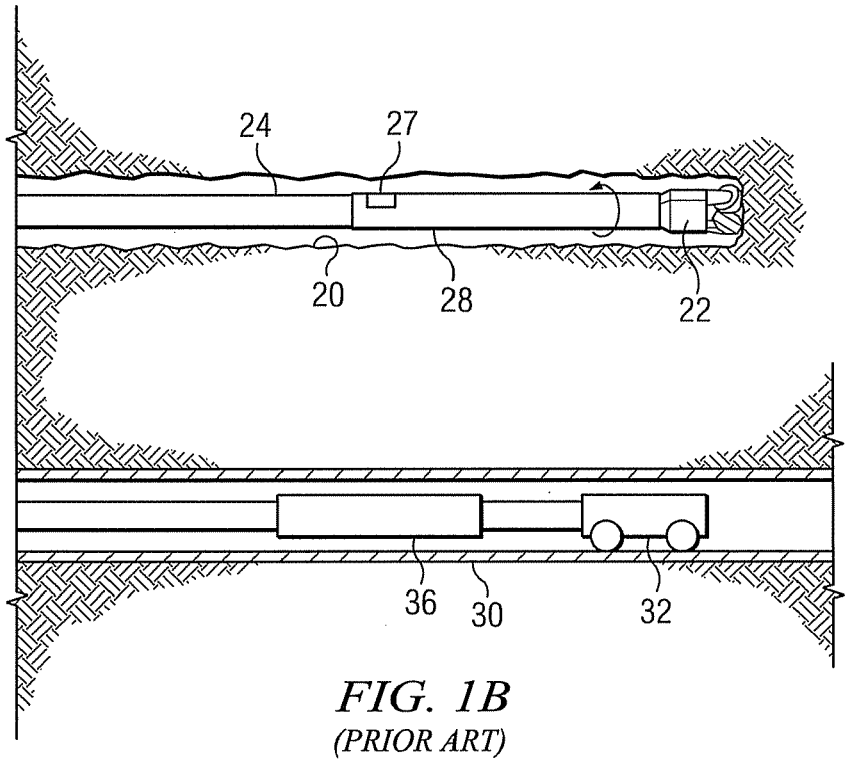
FIG. 1B (PRIOR ART)
Figure 2A:
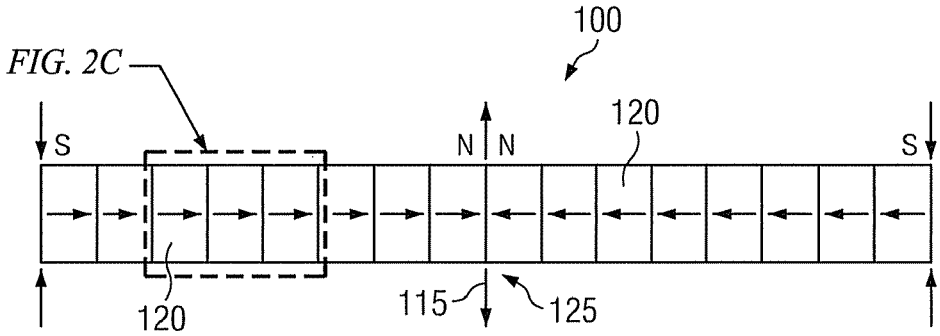
FIGS. 2A, 2B, and 2C depict exemplary wellbore tubulars magnetized according to the principles of the present invention.
Figure 2B:
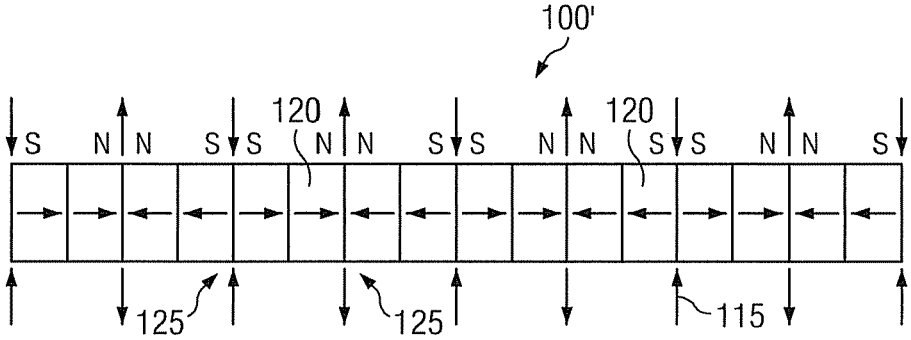
Figure 2C:
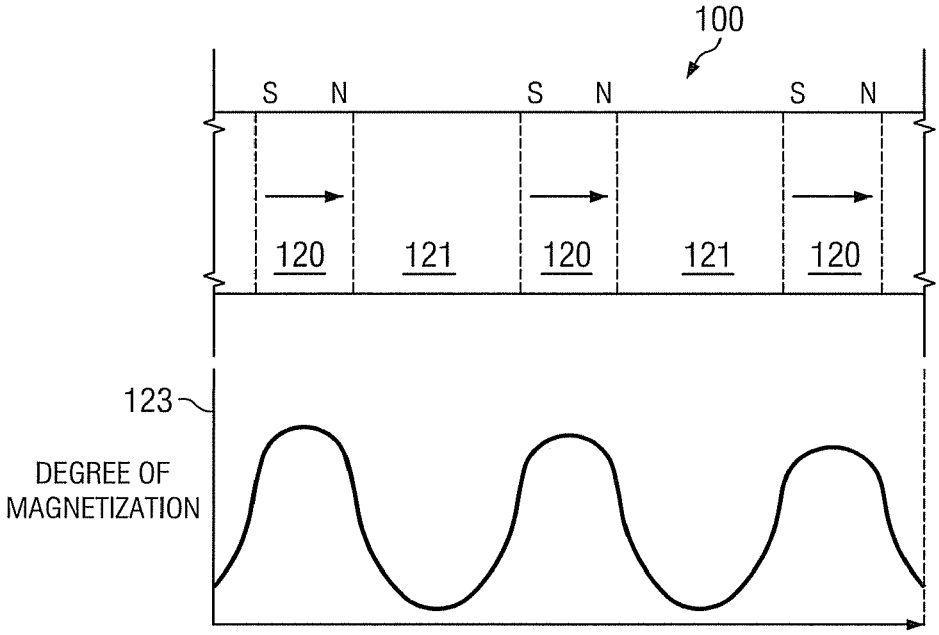

FIGS. 2A through 2C show schematic illustrations of wellbore tubulars 100 and 100' magnetized according to exemplary embodiments of this invention. Tubulars 100 and 100' include a plurality of discrete magnetized zones 120 (typically three or more). Each magnetized zone 120 may be thought of as a discrete cylindrical magnet having a north N pole on one longitudinal end thereof and a south S pole on an opposing longitudinal end thereof. Moreover, the tubulars 100 and 100' are magnetized such that they include at least one pair of opposing north-north NN or south-south SS poles 125. Such opposing magnetic poles effectively focus magnetic flux outward from or inward towards the tubular as shown at 115 on FIGS. 2A and 2B. In the exemplary embodiment shown on FIG. 2A, tubular 100 includes 16 discrete magnetized zones 120 configured such that tubular 100 also includes a single pair of opposing NN poles 125 located at about the midpoint along the length thereof. Alternative embodiments include at least three pairs of opposing poles. For example, in the exemplary embodiment shown on FIG. 2B, tubular 100' includes 16 discrete magnetized zones 120 configured such that tubular 100' includes four pairs of opposing NN poles and three pairs of opposing SS poles (for a total of seven pairs of opposing magnetic poles) spaced at substantially equal intervals along the length of tubular 100'.

It will be appreciated that this invention is not limited to any particular number or location of the pairs of opposing NN and/or SS poles. Rather, the magnetized tubulars may include substantially any number of pairs of opposing NN and/or SS poles located at substantially any positions on the tubulars. Moreover, while FIGS. 2A and 2B show tubulars having 16 discrete magnetized zones 120, this invention is not limited to tubulars having any particular number of discrete magnetized zones. Rather, tubulars magnetized in accordance with this invention will include substantially any number of magnetized zones 120, although exemplary embodiments including six or more magnetized zones may be advantageous for certain applications in that tubulars having a greater number of magnetized zones tend to have a higher magnetic field strength thereabout (other factors being equal).

It will be appreciated that FIGS. 2A and 2B are simplified schematic representations of exemplary embodiments of tubular magnetization. In practice, tubular magnetization may be, in some cases, more complex. This may be illustrated, for example, with further reference to FIG. 2C, which shows a more detailed view of the magnetization of a portion of tubular 100 shown on FIG. 2A. In the exemplary embodiment shown, magnetized zones 120 are longitudinally spaced at some interval along tubular 100 with less magnetized zones 121 interspersed therebetween. In such a configuration, the degree of magnetization 123 in tubular 100 is relatively high in the region of the magnetized zones 120 and tails off to a minimum (or even to substantially non magnetized) in the less magnetized zones 121. It will be understood that the invention is not limited in this regard.

Figure 3A:
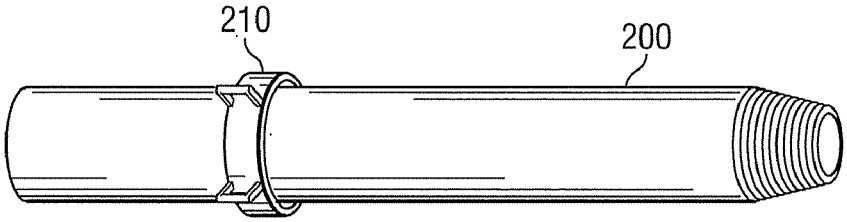
FIGS. 3A and 3B depict exemplary methods for magnetizing wellbore tubulars according to this invention.
Figure 3B:
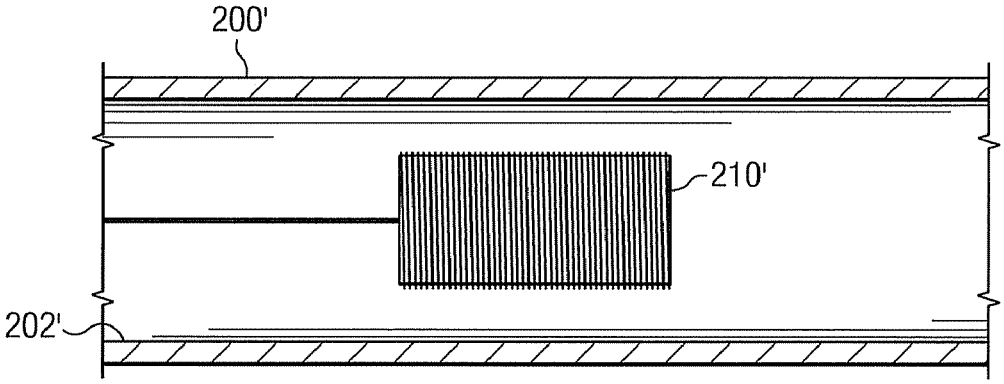

Referring now to FIGS. 3A and 3B, exemplary tubulars may be magnetized according to substantially any suitable technique. For example, FIG. 3A illustrates a preferred arrangement for magnetizing a wellbore tubular in which an electromagnetic coil 210 (often referred to in the art as a "gaussing coil") having a central opening (not shown) is deployed about an exemplary tubular 200. Such coils 210, which are commonly used in the art to magnetize the threaded ends of well bore tubulars, are suitable to magnetize substantially any number of discrete zones along the length of the tubular 200 (as shown on FIGS. 2A through 2C). For example, in one exemplary approach, a coil 210 may be located about one portion of the tubular 200. A direct electric current may then be passed through the windings in coil 210, which imparts a substantially permanent strong magnetization to the tubular 200 in the vicinity of the coil 210 (e.g., magnetized zone 120 shown on FIG. 2C). The degree of magnetization in tubular 200 decreases with increasing longitudinal distance from the coil 210 (e.g., as shown in less magnetized zones 121 shown on FIG. 2C). After some period of time (e.g., 5 to 15 seconds), the current may be interrupted and the coil 210 moved longitudinally to another portion of tubular 200 where the process is repeated. Such an approach may result, for example, in a magnetized tubular as shown on FIG. 2C, in which magnetized zones 120 are longitudinally spaced along the length of the tubular with less magnetized zones 121 interspersed therebetween. As described above tubulars magnetized in accordance with this invention may include substantially any number of magnetized zones 120 with substantially any longitudinal spacing therebetween.

With continued reference to FIGS. 3A and 3B, opposing magnetic poles may be imposed, for example, by changing the direction (polarity) of the electric current between adjacent zones. Alternatively, the coil 210 may be redeployed on the tubular 200 such that the electric current flows in the opposite circumferential direction about the tubular 200. In this manner, a tubular may be magnetized such that substantially any number of discrete magnetic zones (e.g., zones 120 shown on FIGS. 2A through 2C) may be imposed on the tubular 200 to form substantially any number of pairs of opposing magnetic poles (e.g., opposing poles 125 shown on FIGS. 2A and 2B). The use of an electromagnetic coil 210 deployed about the tubular 200 may be advantageous in that such an electromagnetic coil 210 imparts a magnetic field having flux lines substantially parallel with the axis of the tubular.

In certain embodiments, it may be advantageous to provide the coil 210 with magnetic shielding (not shown) deployed on one or both of the opposing longitudinal ends of the coil 210. The use of magnetic shielding is intended to localize the imposed magnetization in the tubular, for example, by reducing the amount of magnetic flux (provided by the coil) that extends longitudinally beyond the coil. In one exemplary embodiment, such magnetic shielding may include, for example, a magnetically permeable metallic sheet deployed on the longitudinal face of the coil 210.

Moreover, it will be appreciated that electromagnetic coil 210 may be traversed longitudinally along all or some portion of the length of tubular 200 during magnetization thereof. For example, tubular 200 may be held substantially stationary relative to the earth while coil 210 is traversed therealong (alternatively the coil may be held stationary while the tubular is traversed therethrough, for example, while being lowered into a borehole). In such arrangements, slower movement of the coil (or tubular) tends to result in a stronger magnetization of the tubular (for a given electrical current in the coil). To form a pair of opposing magnetic poles the direction (polarity) of the electric current may be changed, for example, when the coil 210 reaches some predetermine location (or locations) on the tubular 200.

It will also be appreciated that, in accordance with this invention, wellbore tubulars may also be magnetized via a magnetic and/or electromagnetic source deployed internal to the tubular (although in general external magnetization is preferred). For example, FIG. 3B, shows an internal electromagnetic source 210' (e.g., including a magnetic core having a winding wrapped thereabout) deployed in the through bore 202' of tubular 200'. Such an internal electromagnetic source 210' may be used to magnetize individual wellbore tubulars or, alternatively, lowered into a cased borehole to magnetize a section of a predeployed casing string. Tubular 200' may be magnetized, for example, as described above with respect to FIG. 3A, via moving source 210' to discrete locations in the tubular 200'. Opposing poles may likewise be formed via occasional current reversals as described above. Moreover, source 210' may also include magnetic shielding (not shown) to localize tubular magnetization to more discrete zones.

Figure 4:
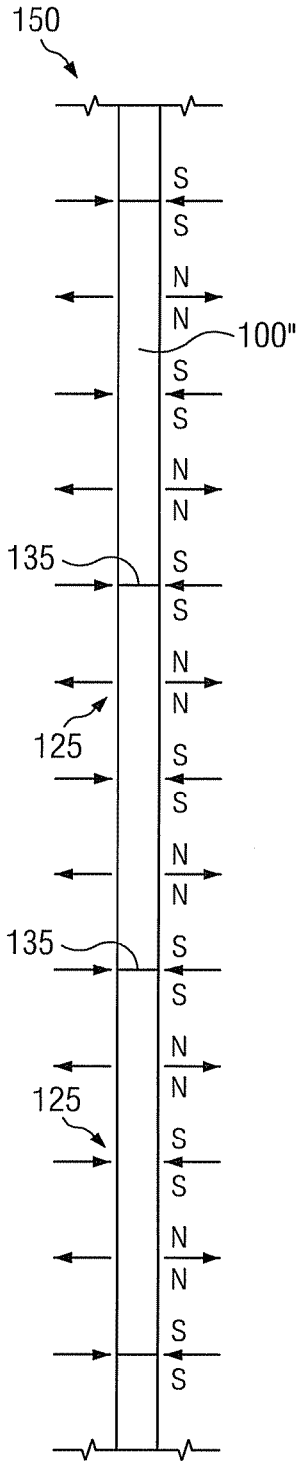
FIG. 4 depicts a casing string including a plurality of wellbore tubulars magnetized according to this invention.

Turning now to FIG. 4, one exemplary embodiment of a casing string 150 including a plurality of premagnetized tubulars 100" is shown. In the exemplary embodiment shown, casing string 150 includes about four times as many pairs of opposing poles 125 as tubulars 100" (three on each tubular 100" and one at each joint 135 between adjacent tubulars 100"). The pairs of opposing poles 125 are spaced at intervals of about one fourth the length of tubular 100" (e.g., at intervals of about 2.5 meters for a casing string including 10 meter tubulars). Casing strings (or sections thereof) magnetized in accordance with this invention include a plurality of pairs of opposing poles with the longitudinal spacing between adjacent pairs of opposing poles less than that of the length of a single tubular (e.g., between about one half and one twelfth the length of the tubulars). In other words, casing strings (or sections thereof) magnetized in accordance with this invention include a greater number of pairs of opposing poles than tubulars (e.g., between about 2 and 12 times the number of pairs of opposing poles as tubulars).

It will be appreciated that the preferred spacing between pairs of opposing poles depends on many factors, such as the desired distance between the twin and target wells, and that there are tradeoffs in utilizing a particular spacing. In general, the magnetic field strength about a casing string (or section thereof) becomes more uniform along the longitudinal axis of the casing string with reduced spacing between the pairs of opposing poles (i.e., increasing ratio of pairs of opposing poles to tubulars). However, the fall off rate of the magnetic field strength as a function of radial distance from the casing string tends to increase as the spacing between pairs of opposing poles decreases. Thus, it may be advantageous to use a casing string having more closely spaced pairs of opposing poles for applications in which the distance between the twin and target wells is relatively small and to use a casing string having a greater distance between pairs of opposing poles for applications in which the distance between the twin and target wells is larger. Moreover, for some applications it may be desirable to utilize a casing string having a plurality of magnetized sections, for example a first section having a relatively small spacing between pairs of opposing poles and a second section having a relatively larger spacing between pairs of opposing poles.

Figure 5A:
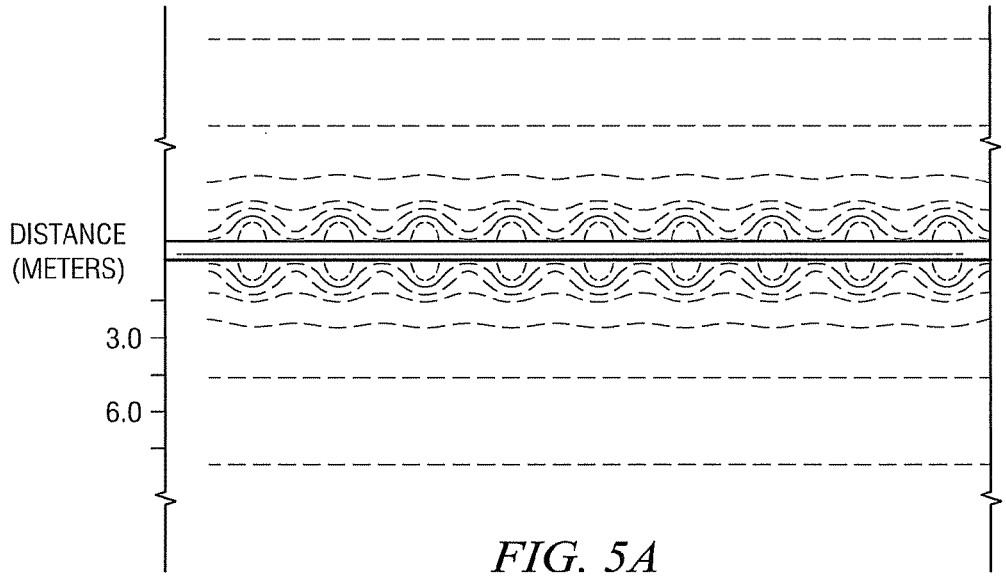
FIG. 5A is a contour plot of the theoretical magnetic flux density about the casing string shown on FIG. 4.

The magnetic field about exemplary casing strings may be modeled, for example, using conventional finite element techniques. FIG. 5A shows a contour plot of the flux density about the casing string configuration shown on FIG. 4. As described above, casing string 150 includes four pairs of opposing magnetic poles per tubular 100". As also described above, each tubular 100" is configured to include 16 discrete magnetic zones. Further, in this exemplary model, each tubular has a length of 10 meters and a diameter of 0.3 meters, which is consistent with lower well dimensions in SAGD applications. It will be appreciated that this invention is not limited by exemplary model assumptions. As shown on FIG. 5A, the magnetic field strength (flux density) is advantageously highly uniform about the casing string, with the contour lines essentially paralleling the casing string at radial distances greater than about three meters.

It will be appreciated that the terms magnetic flux density and magnetic field are used interchangeably herein with the understanding that they are substantially proportional to one another and that the measurement of either may be converted to the other by known mathematical calculations.

A mathematical model, such as that described above with respect to FIG. 5A, may be utilized to create a map of the magnetic field about the target well as a function of measured depth. In one exemplary embodiment, magnetic field measurements about each magnetized tubular made prior to its deployment in the target well may enhance such a map. In this manner, the measured magnetic properties of each tubular may be included as input parameters in the model. During twinning of the target well, magnetic field measurements (such as x, y, and z components measured by a tri-axial magnetometer) may be input into the model (e.g., into a look up table or an empirical algorithm based on the model) to determine the distance and direction to the target well.

Figure 5B:
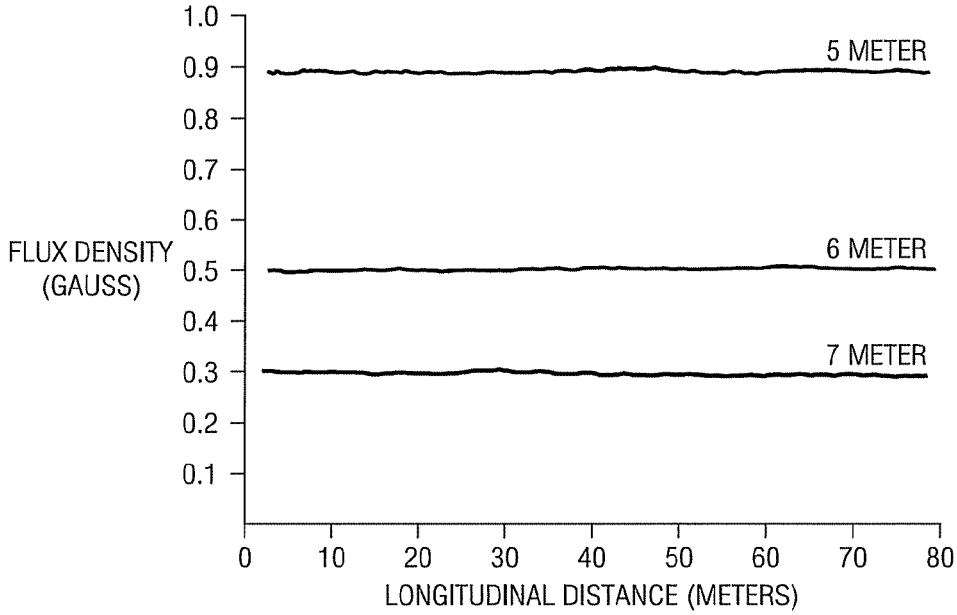
FIG. 5B is a plot of the magnetic field strength versus measured depth at radial distances of 5, 6, and 7 meters.

Turning now to FIG. 5B, the magnetic field strength verses measured depth (longitudinal position along the casing string) is shown at radial distances of 5, 6, and 7 meters from the casing string shown on FIG. 4. As shown, the magnetic field strength is approximately constant along the length of the casing string at any particular radial distance (e.g., within a few percent at a radial distance of 6 meters). Moreover, the magnetic field strength is shown to decrease with increasing radial distance (decreasing from about 0.9 to 0.3 Gauss between a radial distance of 5 and 7 meters). It will be appreciated that during exemplary twinning applications of such a target well, the radial distance to the target well may be determined and controlled based simply on magnetic field strength measurements. As described in more detail below, the direction to the target well may likewise be controlled based on measurements of the direction of the magnetic field in the plane of the tool face.

Figure 6:
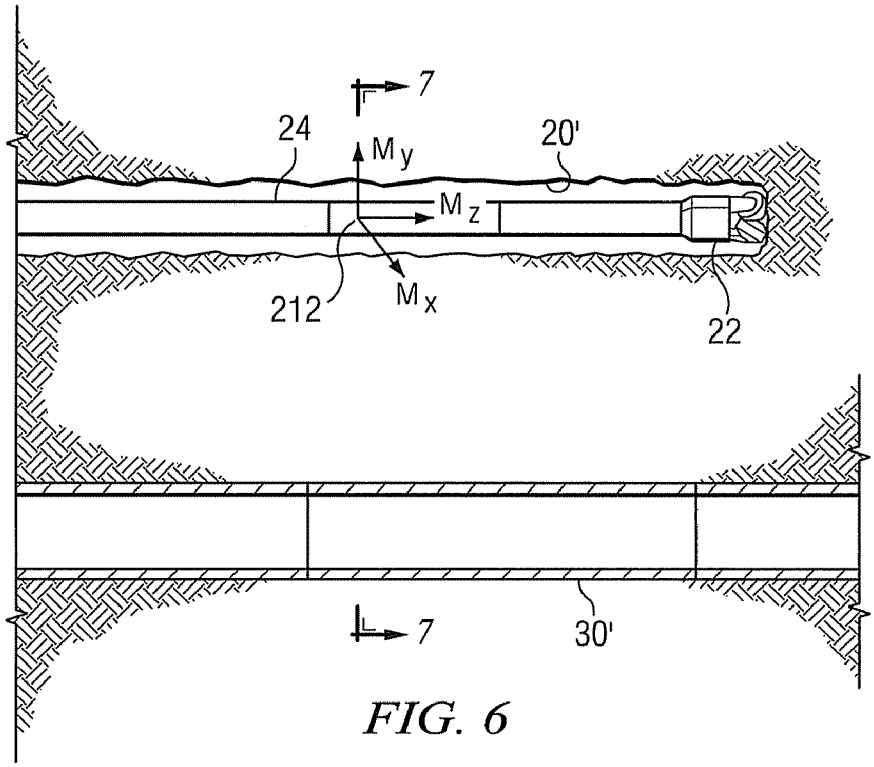
FIG. 6 depicts one exemplary method of this invention for drilling twin wells.

Turning now to FIG. 6, one exemplary technique in accordance with this invention is shown for drilling twin wells, for example, for the above described SAGD applications. In the exemplary embodiment shown, the lower (target) borehole 30' is drilled first, for example, using conventional directional drilling and MWD techniques. However, the invention is not limited in this regard. The target borehole 30' is then cased using a plurality of premagnetized tubulars (such as those shown on FIGS. 2A and/or 2B as described above). As also described above, the use of a premagnetized casing string results in an enhanced magnetic field around the target borehole 30'. Measurements of the enhanced magnetic field may then be used to guide subsequent drilling of the twin well 20'. In the embodiment shown, drill string 24 includes a tri-axial magnetic field measurement sensor 212 deployed in close proximity to the drill bit 22. Sensor 212 is used to passively measure the magnetic field about target well 30'. Such passive magnetic field measurements are then utilized to guide continued drilling of twin well 20' along a predetermined path relative to the target well 30', for example, via comparing them to a map of the magnetic field about the target well 30' as described above with respect to FIGS. 5A and 5B.

It will be appreciated that this invention is not limited to drilling the lower well first. Nor is this invention limited to a vertical separation of the boreholes, or to SAGD applications. Rather, exemplary methods in accordance with this invention may be utilized to drill twin wells having substantially any relative orientation for substantially any application. For example, embodiments of this invention may be utilized for river crossing applications (such as for underwater cable runs).

With continued reference to FIG. 6, exemplary embodiments of sensor 212 are shown to include three mutually orthogonal magnetic field sensors, one of which is oriented substantially parallel with the borehole axis. Sensor 212 may thus be considered as determining a plane (defined by $B_X$ and $B_Y$) orthogonal to the borehole axis and a pole ($B_Z$) parallel to the borehole axis, where $B_X$, $B_Y$, and $B_Z$ represent measured magnetic field vectors in the x, y, and z directions. As described in more detail below, exemplary embodiments of this invention may only require magnetic field measurements in the plane of the tool face ($B_X$ and $B_Y$ as shown on FIG. 6).

The magnetic field about the magnetized casing string may be measured and represented, for example, as a vector whose orientation depends on the location of the measurement point within the magnetic field. In order to determine the magnetic field vector due to the target well (e.g., target well 30') at any point downhole, the magnetic field of the earth is subtracted from the measured magnetic field vector. The invention is not limited in this regard, since the magnetic field of the earth may be included in a mathematical model, such as that described above with respect to FIGS. 5A and 5B. The magnetic field of the earth (including both magnitude and direction components) is typically known, for example, from previous geological survey data. However, for some applications it may be advantageous to measure the magnetic field in real time on site at a location substantially free from magnetic interference, e.g., at the surface of the well or in a previously drilled well. Measurement of the magnetic field in real time is generally advantageous in that it accounts for time dependent variations in the earth's magnetic field, e.g., as caused by solar winds. However, at certain sites, such as an offshore drilling rig, measurement of the earth's magnetic field in real time may not be practical. In such instances, it may be preferable to utilize previous geological survey data in combination with suitable interpolation and/or mathematical modeling (i.e., computer modeling) routines.

The earth's magnetic field at the tool may be expressed as follows:

$$M_{EX}=H_E(\cos D \sin Az \cos R+\cos D \cos Az \cos Inc \sin R-\sin D \sin Inc \sin R)$$

$$M_{EY}=H_E(\cos D \cos Az \cos Inc \cos R+\sin D \sin Inc \cos R-\cos D \sin Az \sin R)$$

$$M_{EZ}=H_E(\sin D \cos Inc-\cos D \cos Az \sin Inc) \qquad \text{Equation 1}$$

where $M_{EX}$, $M_{EY}$, and $M_{EZ}$ represent the x, y, and z components, respectively, of the earth's magnetic field as measured at the downhole tool, where the z component is aligned with the borehole axis, $H_E$ is known (or measured as described above) and represents the magnitude of the earth's magnetic field, and D, which is also known (or measured), represents the local magnetic dip. Inc, Az, and R represent the Inclination, Azimuth and Rotation (also known as the gravity tool face), respectively, of the tool, which may be obtained, for example, from conventional gravity surveying techniques. However, as described above, in various relief well applications, such as in near horizontal wells, azimuth determination from conventional surveying techniques tends to be unreliable. In such applications, since the measured borehole and the target borehole are essentially parallel (i.e., within a five or ten degrees of being parallel), Az values from the target well, as determined, for example in a historical survey, may be utilized.

The magnetic field vectors due to the target well may then be represented as follows:

$$M_{TX}=B_X-M_{EX}$$

$$M_{TY}=B_Y-M_{EY}$$

$$M_{TZ}=B_Z-M_{EZ} \qquad \text{Equation 2}$$

where $M_{TX}$, $M_{TY}$, and $M_{TZ}$ represent the x, y, and z components, respectively, of the magnetic field due to the target well and $B_X$, $B_Y$, and $B_Z$, as described above, represent the measured magnetic field vectors in the x, y, and z directions, respectively.

The artisan of ordinary skill will readily recognize that in determining magnetic field vectors about the target well it may also be necessary to subtract other magnetic field components from the measured magnetic field vectors. For example, such other magnetic field components may be the result of drill string and/or drilling motor interference. Techniques for accounting for such interference are well known in the art. Moreover, magnetic interference may emanate from other nearby cased boreholes. In SAGD applications in which multiple sets of twin wells are drilled in close proximity, it may be advantageous to incorporate the magnetic fields of the various nearby wells into a mathematical model.

The magnetic field strength due to the target well may be represented as follows:

$$M=\sqrt{M_{TX}^2+M_{TY}^2+M_{TZ}^2} \qquad \text{Equation 3}$$

where M represents the magnetic field strength due to the target well and $M_{TX}$, $M_{TY}$, and $M_{TZ}$ are defined above with respect to Equation 2.

Figure 7:
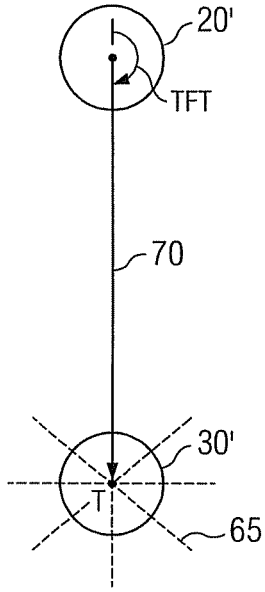
FIG. 7 is a cross sectional view of FIG. 6.

Turning now to FIG. 7, a cross section as shown on FIG. 6 is depicted looking down the longitudinal axis of the target well 30'. Since the axes of the twin well and the target well are approximately parallel, the view of FIG. 7 is also essentially looking down the longitudinal axis of the twin well 20'. The magnetic flux lines 65 emanating from the target well 30' are shown to substantially intersect the target well 30' at a point T. Thus a magnetic field vector 70 determined at the twin well 20', for example, as determined by Equations 1 and 2, provides a direction from the twin well 20' to the target well 30'. Since the twin well 20' and target well 30' are typically essentially parallel, determination of a two-dimensional magnetic field vector resulting from the target well 30' (e.g., in the plane of the tool face defined by $B_X$ and $B_Y$ on FIG. 6) is advantageously sufficient for determining the direction from the twin well 20' to the target well 30'. Such two-dimensional magnetic field vectors may be determined, for example, by solving for $M_{TX}$ and $M_{TY}$ in Equation 2. Thus measurement of the magnetic field in two dimensions ($B_X$ and $B_Y$) may be sufficient for determining the direction from the twin well 20' to the target well 30'. Nevertheless, for certain applications it may be preferable to measure the magnetic field in three dimensions.

A tool face to target (TFT) angle may be determined from the x and y components of the magnetic field due to the target well ($M_{TX}$ and $M_{TY}$ in Equation 2) as follows:

$$TFT = \arctan\left(\frac{M_{TX}}{M_{TY}}\right) + \arctan\left(\frac{Gx}{Gy}\right) \qquad \text{Equation 4}$$

where TFT represents the tool face to target angle, $M_{TX}$ and $M_{TY}$ represent the x and y components, respectively, of the magnetic field vector due to the target well, and $G_X$ and $G_Y$ represent x and y components of the gravitational field in the twin well (e.g., measured via accelerometers deployed near sensor 212 shown on FIG. 6). As shown on FIG. 7, the TFT indicates the direction from the twin well 20' to the target well 30' relative to the high side of the twin well 20'. For example, a TFT of 180 degrees, as shown on FIG. 7, indicates that the target well 30' is directly below the twin well 20' (as desired in a typical SAGD twinning operation). It will be appreciated that in certain quadrants, Equation 4 does not fully define the direction from the measured well 20' to the target well 30'. Thus in such applications, prior knowledge regarding the general direction from the measured well to the target well (e.g., upwards, downwards, left, or right) may be utilized in combination with the TFT values determined in Equation 3. It will be appreciated that TFT may also be expressed relative to substantially any reference such as high side, right side, etc. The invention is not limited in this regard.

With reference again to FIG. 6 and as described above, a typical SAGD application requires that a horizontal portion of the twin well is drilled a substantially fixed distance substantially directly above a horizontal portion of the target well (i.e., not deviating more than about 1-2 meters up or down or to the left or right of the lower well). As also described above, the separation distance between the two wells may be maintained by controlling the drilling direction such that the magnetic field strength is maintained within a predetermined range (based upon the particular distance required and the magnetization characteristics of the wellbore tubulars). The placement of the twin well substantially directly above the target well may be maintained by controlling the drilling direction such that the TFT angle is maintained within a predetermined range of 180 degrees. At a TFT angle of 180 degrees, the twin well resides directly above the target well. Table 1 summarizes exemplary TFT tolerances for separation distances of 6 and 12 meters and left right tolerances of 1 and 2 meters. For example, to maintain a left right tolerance of ±1 meter at a separation distance of 6 meters requires that twin well be drilled such that the TFT is maintained at 180±9 degrees. Likewise, to maintain a left right tolerance of ±2 meters at a separation distance of 6 meters requires that the TFT be maintained at 180±19 degrees.

TABLE 1

| | 6 meters | 12 meters |
|---|---|---|
| +/−1 meters | ±9 degrees | ±4 degrees |
| +/−2 meters | ±19 degrees | ±9 degrees |

While the passive ranging techniques described herein require only a single magnetic field sensor (e.g., sensor 212 on FIG. 6), it will be appreciated that embodiments of this invention may be further enhanced via the use of a second magnetic field sensor longitudinally offset from the first sensor. The use of two sets of magnetometers typically improves data density (i.e., more survey points per unit length of the twin well), reduces the time required to gather passive ranging vector data, increases the quality assurance of the generated data, and builds in redundancy. Moreover, in certain applications, determination of the TFT at two or more points along the twin well may be sufficient to guide continued drilling thereof. Additionally, and advantageously for embodiments including first and second longitudinally spaced magnetic field sensors, comparison of TFT at the first and second sensors indicates the relative direction of drilling of the twin well with respect to the target well. Further, since the drill bit is typically a known distance below the lower sensor, a TFT at the drill bit may be determined by extrapolating the TFT values from the first and second sensors.

The drilling direction of the twin well relative to the target well may be controlled by substantially any known method. The invention is not limited in this regard. For example, in one exemplary embodiment, magnetic field measurements may be transmitted to the surface (i.e., via any conventional telemetry technique) where they are input into a numerical model (e.g., a magnetic field map as described above with respect to FIGS. 5A and 5B) to determine the direction and distance to the target well. The direction and distance may be compared to desired values to determine any necessary changes to the drilling direction. Such changes in the drilling direction may then, for example, be used to compute changes to the blade positions of a steering tool (e.g., a three-dimensional rotary steerable tool), which may then be transmitted back downhole. Alternatively, the magnetic field measurements may be utilized to compute magnetic field strength and TFT, which may then be utilized to determine changes to the drilling direction (if necessary).

Moreover, it will be appreciated that the drilling direction of the twin well may be controlled relative to the target well using closed loop control. In general, closed loop control of the drilling direction includes determining changes in the drilling direction of the twin well downhole (e.g., at a downhole controller) based on the magnetic field measurements. Such closed loop control advantageously minimizes the need for communication between a drilling operator and the bottom hole assembly, thereby preserving normally scarce downhole communication bandwidth and reducing the time necessary to drill a twin well. Closed loop control of the drilling direction may also advantageously enable control data (magnetic field measurements) to be acquired and utilized at a significantly increased frequency, thereby improving control of the drilling process and possibly reducing tortuosity of the twin well.

Figure 8:
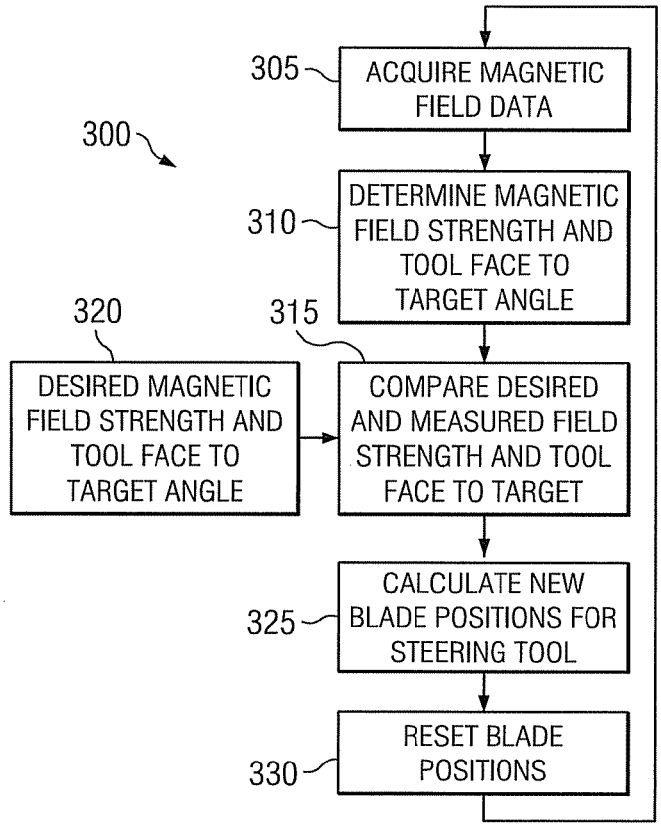
FIG. 8 depicts an exemplary closed loop control method for controlling the direction of drilling of a twin well relative to a target well.

Referring now to FIG. 8, one exemplary control method 300 is illustrated for controlling the direction of drilling a twin well relative to a target well. As shown at 305, magnetic field data is acquired, for example, using a tri-axial magnetometer (e.g., sensor 212 on FIG. 6). The magnetic field strength due to the target well and the tool face to target angle are then computed downhole at 310 based on the measured magnetic field data. At 315 a controller (not shown) compares the magnetic field strength and TFT computed at 310 with a desired field strength and TFT 320 (e.g., preprogrammed into the controller or received via occasional communication with the surface). The comparison may include, for example, subtracting the computed magnetic field strength from the desired magnetic field strength and subtracting the computed TFT from the desired TFT to determine offset values. The offset values may then be utilized to compute a new drilling direction (if necessary), which in turn may be utilized to compute new steering tool blade positions at 325. For example, the above described offset values may be used in combination with a look up table or a predetermined algorithm to determine the new steering tool blade positions. The steering tool blades may then be set to the new positions (if necessary) at 330 prior to acquiring new magnetic field measurements at 305 and repeating the loop.

It will be appreciated that closed loop control methods, such as that described above, may be utilized to control the direction of drilling over multiple sections of a well (or even, for example, along an entire well plan). This may be accomplished, for example, by dividing a well plan into a plurality of sections, each having desired magnetic field properties (e.g., magnetic field strength and TFT). Such a well plan would typically further include predetermined inflection points between the sections. The inflection points may be defined by substantially any method known in the art, such as by predetermined inclination, azimuth, and/or measured depth. Alternatively, an inflection point may be defined by a magnetic beacon (or anomaly) premagnetized into the target casing string. During drilling of a multi-section twin well, the drilling direction of the twin well may be controlled with respect to the target well in each section, for example, as described above with respect to FIG. 8. In this manner, an entire twin well may potentially be drilled according to a predetermined well plan without intervention from the surface. Surface monitoring and/or interrupt may then be by way of supervision of the downhole-controlled drilling. Alternatively, directional drilling can be undertaken, if desired, without communication with the surface.

In certain applications it may be advantageous to determine the location of the magnetic sensor deployed in the twin well (e.g., sensor 212 on FIG. 6) relative to one of the pairs of opposing poles on the target well casing string. The longitudinal position of the magnetic sensor relative to one of the pairs of opposing poles may be determined, for example, via measuring the component of the magnetic flux density parallel to the longitudinal axis of the twin well (the z direction as shown on FIG. 6). It will be appreciated that the longitudinal component of the magnetic flux density is substantially zero (a minimum) at the pairs of opposing poles and increases to a maximum at about the mid point between two pairs of adjacent opposing poles. Conversely, the radial component (determined from the x and y directions shown on FIG. 6) may be likewise utilized with the understanding that the radial component of the magnetic flux density is at a maximum adjacent to the pairs of opposing poles and at a minimum at about a mid point between the pairs of opposing poles. By monitoring the longitudinal and/or radial components of the magnetic field, any mismatch between the measured depths of the two wells may be accounted. In one advantageous embodiment, the longitudinal component of the magnetic field may be transmitted uphole in substantially real time during drilling (e.g., via mud pulse telemetry). Such dynamic surveying enables the relative longitudinal position between the two wells to be monitored in real time.

Figure 9A:
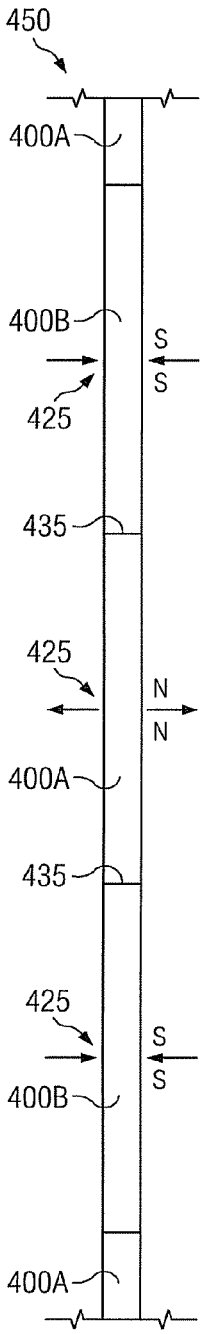
FIG. 9A depicts a string of wellbore tubulars magnetized in accordance with one exemplary embodiment of the present invention.
Figure 9B:
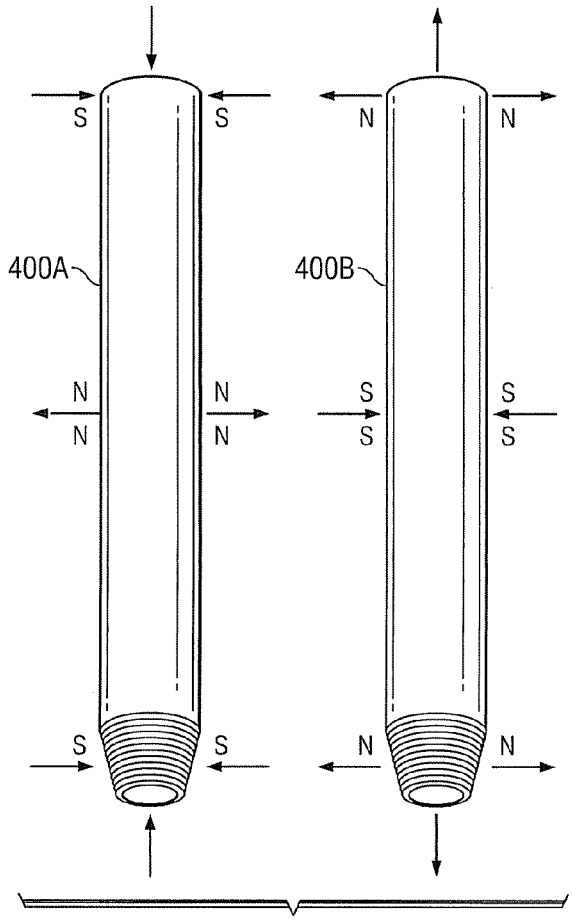
FIG. 9B depicts first and second wellbore tubulars magnetized in accordance with the present invention.

Turning now to FIG. 9A, another exemplary embodiment of a casing string 450 including a plurality of premagnetized tubulars connected end to end is depicted. In the exemplary embodiment depicted, the string 450 includes a plurality of tubulars 400A and 400B having first and second magnetization. With reference to FIG. 9B, tubulars 400A are premagnetized so as to have a pair of NN opposing poles located in a central region of the tubular (e.g., at the midpoint of the tubular). The opposing ends of the tubular 400A have corresponding S poles as depicted. Tubulars 400B are premagnetized so as to have a pair of SS opposing poles located in a central region of the tubular. The opposing ends of the tubular 400B have corresponding N poles. Tubulars 400A and 400B may include multiple (e.g., 3 or more or 6 or more) discrete magnetized zones as depicted, for example, for tubular 100 on FIG. 2A.

The string 450 is formed by joining (threadably connecting) the first and second tubulars 400A and 400B in alternating fashion as depicted. The resultant string 450 has a single pair of opposing poles in the central region (the middle third) of each tubular 400A and 400B. It will be understood that in the exemplary embodiment depicted, the casing string 450 includes a single pair of opposing poles 425 (either NN or SS) per magnetized tubular, preferably located at the mid point of the tubular. Thus the pairs of opposing poles 425 are spaced at intervals about equal to the length of tubulars, while the period of the magnetic field pattern (e.g., the distance from one a NN pair of opposing poles to the next) is about twice the length of the tubular.

As described above with respect to FIG. 4, the preferred spacing between pairs of opposing poles depends on many factors, such as the desired distance between the twin and target wells. It has been found that exemplary casing string 450 depicted on FIG. 9A provides a suitable balance of these factors for a typical SAGD well twinning operation (e.g., in which the distance between the twin wells is in the range from about 5 to about 10 meters). The exemplary casing string 450 embodiment depicted also advantageously locates the pairs of opposing poles in the central region of the tubulars (i.e., away from the joints 435 between tubulars 400A and 400B). Locating the pairs of opposing poles away from the joints has been found to provide for a highly uniform magnetic field about the casing string 450. While the invention is in no way limited by theory, it is believed that locating the pairs of opposing poles at the joints can cause magnetic hot spots and other magnetic anomalies possibly due to the complex geometry at the joint (i.e., due to the presence of the threaded ends and the casing collars).

Figure 10:
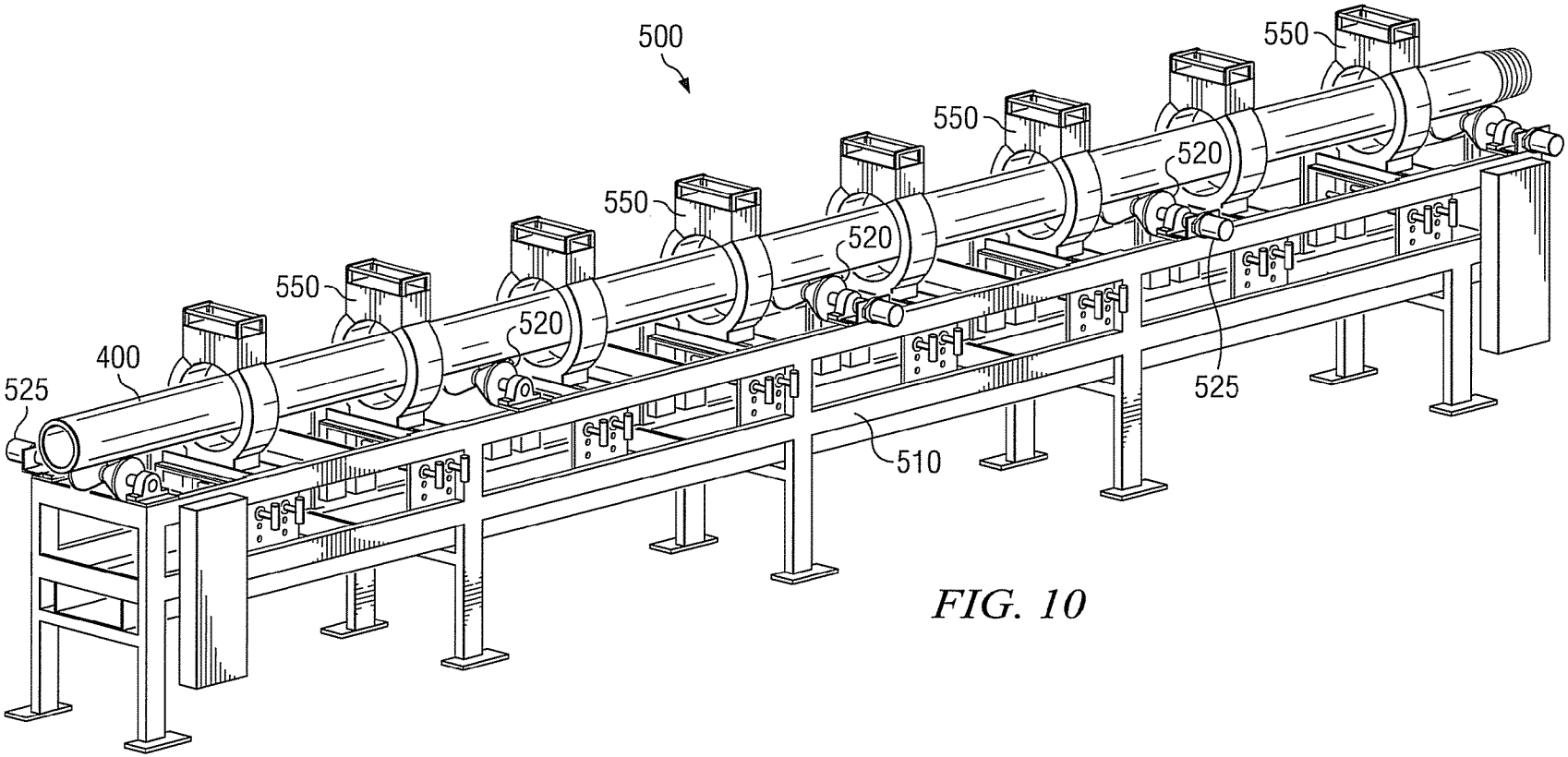
FIG. 10 depicts one exemplary embodiment of an apparatus for magnetizing wellbore tubulars in accordance with the present invention.

With reference now to FIG. 10, tubulars 400A and 400B may be advantageously magnetized using apparatus 500. FIG. 10 is similar to FIG. 2B of commonly assigned, copending U.S. patent application Ser. No. 11/487,984, which is fully incorporated by reference herein. In FIG. 10, apparatus 500 is shown with an exemplary tubular 400 deployed therein. In the exemplary embodiment depicted, apparatus 400 includes a plurality of rollers 520 deployed on a nonmagnetic (e.g., aluminum) frame 510. The plurality of rollers may be thought of as a track along which the tubulars 400 may be moved in a direction substantially parallel with their longitudinal axis. Exemplary embodiments of apparatus 500 may further include one or more motors 525 (e.g., electric or hydraulic motors) deployed on the frame 510 and disposed to drive selected ones (or optionally all) of the rollers 520. In such exemplary embodiments, the tubulars may be advantageously driven along the length of the track thereby reducing tubular handling requirements and enabling the tubulars 400 to be accurately and repeatably positioned along the track.

With continued reference to FIG. 10, apparatus 500 further includes a plurality of magnetizing coils 550 deployed on the frame 510. The coils 550 are substantially coaxial with one another and are disposed to receive tubular 400 as depicted. Suitable coils include, for example, model number WDV-14, available from Western Instruments, Inc., Alberta, Canada. Advantageous embodiments typically include at least 4 magnetizing coils (e.g., from 4 to 32), although the invention is not limited in this regard. In general, embodiments having a large number of regularly spaced coils 550 (e.g., at least 8) tend to be advantageous in that they enable more magnetic force to be imparted to the tubulars 400. This tends to provide a stronger, more uniform magnetic field about the casing string and thus enables more accurate and reliable passive ranging. Closely spaced tubulars also enable the pair of opposing poles to be sharply defined.

With continued reference to FIG. 10, a pair of NN or SS opposing poles (depicted, for example, on FIG. 9B) may be imparted by polarizing adjacent coils 550 in opposite directions. To impart a single pair of opposing poles (e.g., NN) the coils 550 may be connected to an electrical power source such that a direct electrical current (a non-alternating current) flows in a clockwise direction about the tubular in a first subset of the coils and in a counterclockwise direction about the tubular in a second subset of the coils. To impart a pair of opposing poles having the opposite polarity (e.g., SS), the coils 550 may be connected to the power source such that the electrical current flows in a counterclockwise direction about the tubular in the first subset of the coils and in a clockwise direction about the tubular in the second subset of the coils. It will be appreciated that apparatus 500 may be readily and advantageously utilized to impart one or more pairs of NN or SS opposing poles.

In the exemplary embodiment shown, the coils 550 may be advantageously configured to be connected to electrical power substantially simultaneously. This may be accomplished, for example, via a computerized controller or a master switch (e.g., a circuit breaker). In this manner, substantially the entire tubular may be advantageously magnetized in only a few seconds (e.g., about 10), thereby readily enabling large numbers of tubulars to be magnetized in a short period of time. Moreover, it has been found that such simultaneous magnetization advantageously provides for a highly uniform magnetic pattern about the casing string 450 (FIG. 9A). Thus, in preferred embodiments, the magnetizing coils 550 are energized substantially simultaneously.

It will be understood that various aspects and features of the present invention may be embodied as logic that may be represented as instructions processed by, for example, a computer, a microprocessor, hardware, firmware, programmable circuitry, or any other processing device well known in the art. Similarly the logic may be embodied on software suitable to be executed by a processor, as is also well known in the art. The invention is not limited in this regard. The software, firmware, and/or processing device may be included, for example, on a downhole assembly in the form of a circuit board, on board a sensor sub, or MWD/LWD sub. Alternatively the processing system may be at the surface and configured to process data sent to the surface by sensor sets via a telemetry or data link system also well known in the art. Electronic information such as logic, software, or measured or processed data may be stored in memory (volatile or non-volatile), or on conventional electronic data storage devices such as are well known in the art.

The magnetic field sensors referred to herein are preferably chosen from among commercially available sensor devices that are well known in the art. Suitable magnetometer packages are commercially available from MicroTesla, Ltd., or under the brand name Tensor™ by Reuter Stokes, Inc. It will be understood that the foregoing commercial sensor packages are identified by way of example only, and that the invention is not limited to any particular deployment of commercially available sensors.

Although the present invention and its advantages have been described in detail, it should be understood that various changes, substitutions and alternations can be made herein without departing from the spirit and scope of the invention as defined by the appended claims.

I claim:

1. A method for creating a magnetic profile around a length of coupled wellbore tubulars, the magnetic profile operable to enhance subsequent passive ranging techniques, the method comprising:

(a) magnetizing a first wellbore tubular at three or more locations along a length of the tubular, such that the magnetized tubular includes a single pair of opposing NN poles in a central region of the tubular;

(b) magnetizing a second wellbore tubular at three or more locations along a length of the tubular, such that the magnetized tubular includes a single pair of opposing SS poles in a central region of the tubular; and (c) coupling the first and second wellbore tubulars to one another.

2. The method of claim 1, wherein:

(d) repeating (a), (b), and (c) so that the length of coupled wellbore tubulars includes alternating first and second wellbore tubulars.

3. The method of claim 1, wherein (a) and (b) comprise magnetizing the first and second wellbore tubulars at six or more locations along the lengths thereof.

4. The method of claim 1, wherein (a) and (b) further comprise magnetizing the first and second wellbore tubulars with at least one electromagnetic coil positioned around an outer circumference of the tubular.

5. The method of claim 1, wherein (a) and (b) further comprise:

(i) positioning the corresponding first or second wellbore tubular substantially coaxially in at least 4 longitudinally spaced magnetizing coils deployed on a frame;

(ii) connecting the plurality of coils to an electrical power source such that electrical current flows in a clockwise direction about the tubular in a first subset of the coils and in a counterclockwise direction about the tubular in a second subset of the coils so as to impart the corresponding pair of NN or SS opposing magnetic poles;

(iii) disconnecting the coils from the electrical power source; and (iv) removing the tubular from the coils.

6. The method of claim 5, wherein the magnetizing coils are connected to the electrical power source substantially simultaneously.

7. The method of claim 1, further comprising:

(d) lowering the wellbore tubulars into a borehole.

8. A method for creating a magnetic profile around a length of coupled wellbore tubulars, the magnetic profile operable to enhance subsequent passive ranging techniques, the method comprising:

(a) imparting a first magnetization to each of a first plurality of wellbore tubulars to obtain a plurality of NN tubulars, the first magnetization imparting a single pair of opposing NN poles to a central region of each of the NN tubulars;

(b) imparting a second magnetization to each of a second plurality of wellbore tubulars to obtain a plurality of SS tubulars, the second magnetization imparting a single pair of opposing SS poles to a central region of each of the SS tubulars; and (c) coupling the NN tubulars to the SS tubulars to form the length of coupled wellbore tubulars, said length including an alternating pattern of the NN tubulars and the SS tubulars.

9. The method of claim 8, wherein (a) and (b) comprise magnetizing each of the corresponding first and second pluralities of wellbore tubulars at six or more locations along the lengths thereof.

10. The method of claim 8, wherein (a) and (b) further comprise magnetizing each of the corresponding first and second pluralities of wellbore tubulars with at least one electromagnetic coil positioned around an outer circumference of the tubular.

11. The method of claim 8, wherein (a) and (b) further comprise:

(i) positioning each of the corresponding first and second pluralities of wellbore tubulars substantially coaxially in at least 4 longitudinally spaced magnetizing coils deployed on a frame;

(ii) connecting the plurality of coils to an electrical power source such that electrical current flows in a clockwise direction about the tubular in a first subset of the coils and in a counterclockwise direction about the tubular in a second subset of the coils so as to impart the corresponding pair of NN or SS opposing magnetic poles;

(iii) disconnecting the coils from the electrical power source; and (iv) removing the tubular from the coils.

12. The method of claim 11, wherein the coils are connected to the electrical power source substantially simultaneously.

13. The method of claim 8, further comprising:

(d) lowering the wellbore tubulars into a borehole.

14. A method for creating a magnetic profile around a length of coupled wellbore tubulars, the magnetic profile operable to enhance subsequent passive ranging techniques, the method comprising:

(a) positioning a first wellbore tubular substantially coaxially in at least four longitudinally spaced magnetizing coils deployed on a frame;

(b) connecting the coils to an electrical power source such that direct electrical current flows in a clockwise direction about the first wellbore tubular in a first subset of the coils and in a counterclockwise direction about the first wellbore tubular in a second subset of the coils so as to impart a pair of NN opposing poles in a central region of the first wellbore tubular;

(c) disconnecting the coils from the electrical power source;

(d) removing the first wellbore tubular from the coils;

(e) positioning a second wellbore tubular substantially coaxially in the coils;

(f) connecting the coils to an electrical power source such that direct electrical current flows in a clockwise direction about the second wellbore tubular in the second subset of the coils and in a counterclockwise direction about the second wellbore tubular in the first subset of the coils so as to impart a pair of SS opposing poles in a central region of the second wellbore tubular;

(g) disconnecting the coils from the electrical power source;

(h) removing the second wellbore tubular from the coils; and (i) coupling the first wellbore tubular to the second wellbore tubular.

15. The method of claim 14, further comprising:

(j) repeating (a) through (d), (e) through (h), and (i) so as to form the length of coupled wellbore tubulars, said length including an alternating pattern of the first and second wellbore tubulars.

16. The method of claim 14, wherein the coils are connected to the electrical power source substantially simultaneously in (b) and (f).

17. The method of claim 14, further comprising:

(j) lowering the wellbore tubulars into a borehole.

18. The method of claim 14, wherein (a) and (e) comprise positioning the corresponding first and second wellbore tubulars substantially coaxially in at least eight longitudinally spaced magnetizing coils deployed on the frame.

* * * * *